United States Patent [19]

Yuki

[11] 4,076,523

[45] Feb. 28, 1978

[54] PYROMETALLURGICAL PROCESS FOR LEAD REFINING

[75] Inventor: Toshihiro Yuki, Saganoseki, Japan

[73] Assignee: Nihon Kogyo Kabushiki Kaisha, Tokyo, Japan

[21] Appl. No.: 705,390

[22] Filed: Jul. 15, 1976

Related U.S. Application Data

[63] Continuation-in-part of Ser. No. 625,802, Oct. 28, 1975, abandoned.

[30] Foreign Application Priority Data

Oct. 28, 1974 Japan ..... 49-123323

[51] Int. Cl.[2] ..... C22B 13/00

[52] U.S. Cl. ..... 75/77; 75/7; 75/83; 75/120

[58] Field of Search ..... 75/77, 94, 83, 120, 75/2, 9, 74, 7, 8, 5

[56] References Cited

U.S. PATENT DOCUMENTS

| | | | |
|---|---|---|---|
| 2,658,827 | 11/1953 | Rizo-Patron | 75/77 |
| 3,149,964 | 9/1964 | Schwartz | 75/78 |

*Primary Examiner*—M. J. Andrews

*Attorney, Agent, or Firm*—Seidel, Gonda & Goldhammer

[57] ABSTRACT

A process is provided for obtaining lead bullion by the reduction of sintered ore which is produced by sintering materials including lead concentrate, said process being characterized in that zinc removed tailings are mixed into said materials, whereby the productivity of the pyrometallurgical lead refining may be improved and valuable metals may also be recovered from the zinc removed tailings.

9 Claims, No Drawings

PYROMETALLURGICAL PROCESS FOR LEAD REFINING

BACKGROUND OF THE INVENTION

This application is a continuation-in-part of my U.S. application Ser. No. 625,802 filed Oct. 28, 1975, now abandoned.

This invention relates to pyrometallurgical refining of lead wherein lead oxide obtained by sintering lead concentrates, particularly sulfide minerals such as Galena is subjected to reduction refining treatment. More specifically, this invention relates to a process for enhancing the productivity in the pyrometallurgical lead refining by mixing Waeltz process tailings or magnetically separated tailings in the zinc refining process to the lead concentrate, and then sintering the mixture. The process is concurrently capable of conveniently recovering valuable metals such as gold, silver etc. contained in the aforementioned zinc removed tailings.

Because of the difficulty in reducing lead sulfide to metallic lead, it is a usual method for the pretreatment to once convert lead concentrate to the form of lead oxide by sintering the lead concentrate or by roasting and then sintering it to remove a major portion of sulfur contained therein. When the sintered ore is to be smelted in a blast furnace, it is also known that the production of a suitable amount of slag having a good fluidity is necessary. The lead concentrate, in general, has a small content of slag making components available for the production of slag such as iron, silica, etc. due to its high grade of lead. Accordingly, in maintaining the stable operation of the furnace it is a common practice to charge slag making agents directly into a furnace or to preliminarily add them to the ore as, for example, by adding the slag making agents to the ore during the roasting and sintering treatment. Such slag making agents include iron scraps or pyrite cinders as iron source and siliceous stone, copper smelting furnace slag, or lead smelting furnace slag as silica source. When the iron scraps are employed, they are charged into a blast furnace independently of or together with the sintered ore. When the pyrite cinders are employed, they are mixed into the lead concentrate followed by its sintering and then sintered ores containing pyrite cinder thus obtained are charged into a blast furnace.

The aforementioned method, however, have disadvantages as follows:

When the iron scraps are charged into a blast furnace together with the sintered ore, siliceous stone, coke, etc., it is difficult to have the iron scraps uniformly distribute within the furnace because of their non-uniform shapes. When the pyrite cinders are employed, the problem of the unevenness of the distribution within the furnace can be solved because it is possible to preliminarily mix the pyrite cinders with lead concentrate and sinter them together. However, the iron existing in the pyrite cinder is in the form of hematite and accordingly to reduce it to the ferrous form it is inevitably necessary to raise the gas ratio of CO to $CO_2$ in the furnace gas. However, when the reducing ability of the furnace atmosphere is weakened as the furnace atmosphere fluctuates according to the furnace operating circumstance, the reduction of hematite often becomes insufficient so that slag having a good fluidity is not produced. In such case, the operation of the furnace becomes unstable and also the lead slag loss, namely loss of lead into the slag, is increased.

The Waeltz process slag in the zinc refining process as mentioned hereinbefore refers to the tailings left by fuming zinc from the distillation residue from pyrometallurgical zinc refining process or by fuming zinc from the leaching residue from hydrometallurgical zinc refining process, said fuming of zinc being carried out by mixing such residue with coke and treating the mixture in a rotary kiln by the aid of fine coal burning. Such additional treatment is required to recover zinc from the distillation or leaching residue which has still a high content of zinc. Also, in the distillation refining of zinc, when the zinc is sufficiently reduced and fumed off, the co-existent iron oxide has been converted into elemental iron. Therefore, the distillation residue may be separated into a nonmagnetic residue portion having a high zinc content and a magnetic residue portion containing iron (hereinafter referred to as magnetically separated tailings). The former, that is, the high zinc containing residue portion is repeatedly treated in the zinc refining process. The tailings which are left by removing zinc from the residue discharged in the pyro- or hydro metallurgical zinc refining process, as explained with reference to Waeltz tailings and magnetically separated tailings hereinabove, are termed herein "zinc removed tailings". Such zinc removed tailings are composed of grains, for the most part, having about 10 mm diameter in contrast to the aforementioned pyrite cinders which are composed of fine particles, for the most part, having about 0.1 mm diameter. Accordingly, zinc removed tailings do not present a dust problem during its handling.

The zinc removed tailings have a general composition as follows:

Zn: less than 5.0%
Cu: 1–10.0%
Au: 1.0–10.0 g/Ton
Ag: 500–1,500 g/Ton
Si: 2.0–15.0%
Fe: 50.0–65.0%

An example of its composition is set forth below in Table I.

Table 1

| Ingredients | Au | Ag | Cu | Fe | Zn | Si | C |
|---|---|---|---|---|---|---|---|
| Contents | 2.7g/T | 600g/T | 4.8% | 58% | 2.5% | 8% | 3% |

Since the zinc removed tailings contain valuable metals such as gold and silver as set forth above, they must be treated to recover valuable metals from them. Previously, the zinc removed tailings have been treated mainly by a smelting furnace or converter to recover valuable metals from them. But, when they are treated in the smelting furnace, the reducing atmosphere in the furnace prevents the iron from sufficiently falling into slag and the treatment capacity of the furnace is inevitably restricted. In case the zinc removed tailings are treated in the converter, an increase in the amount of the zinc removed tailings to be treated results in a proportional decrease in the amount of matte which is a primary object to be treated by the converter. Accordingly, from the standpoint of productivity, there is a limit in treating the zinc removed tailings in the converter. For the aforementioned reasons, the conventional treatment processes are both far from being effective.

I have discovered that the zinc removed tailings have excellent effects as a slag making agent in the lead blast furnace and also as a desulfurizing agent and a reducing agent.

Based on this discovery, this invention provides a pyrometallurgical lead refining process having a high productivity. This invention further provides a pyrometallurgical lead refining process in which the lead fraction lost into a slag is less, the operation of the furnace is stable and yet valuable metals contained in the zinc removed tailings may be effectively recovered.

DETAILED DESCRIPTION OF THE PREFERRED EMBODIMENT

This invention resides in a pyrometallurgical lead refining process comprising mixing lead concentrate with additives including flux such as lime stone, siliceous stone, etc., desulfurizing the mixture in a sintering process, and charging the resultant sintered ore into a blast furnace together with coke to produce lead bullion from the lead concentrate, characterized in that the zinc removed tailings obtained in the zinc refining process are mixed with said lead concentrate, lime stone, siliceous stone, etc., the mixture is sintered together and the resultant sintered ore mixture is employed as a charge into the blast furnace. As is well known in the art, the lead concentrate is one in which the lead content has been increased by a suitable ore dressing operation such as gravity or magnetic separation for the lead containing ore. In general, the lead concentrate has a following composition:

Pb: 45.0–70.0%
Fe: 1.0–10.0%
Zn: 4.0–15.0%
$SiO_2$: 0.1–3.0%
CaO: 0.01–2.0%
Cu: 0.1–4.0%
Au: 2.0–10.0 g/Ton
Ag: 500–2,000 g/Ton
S: 10.0–25.0%

The mixture may be pelletized prior to the sintering. Sintering are carried out in any conventional sintering machine such as Dwight Lloyd type sintering machine, for example. The temperature and time period of the sintering operation need not be made different from the previous practice. When the desired results can not be obtained by sintering alone, roasting may be carried out to effect oxidation reaction to convert PbS to PbO prior to sintering. Besides, when there is a high content of As in the ores, the lead reduction process later will be complicated, so by the roasting as can be fumed off. When the sintering is effected after roasting treatment by a fluidized roasting furnace, the zinc removed tailings are mixed into the ore mixture after the roasting and before the sintering. When the roasting and sintering treatments are continuously carried out only in a sintering machine without the employment of a roasting furnace, the zinc removed tailings are mixed into the ore mixture before they are charged into the sintering furnace.

A typical sintering process according to this invention comprises mixing into one part of lead concentrate 0.15–0.20 parts of zinc removed tailings, 0.04–0.05 parts of siliceous stone, 0.1–0.15 parts of lime stone, 2.5 parts of sintered powder returned from the succeeding process and 0.3–0.5 parts of lead blast furnace slag, pelletizing the mixture in a pelletizer, charging the pelletized mixture into a sintering machine to heat up to 900° C and desulfurize the pelletized mixture therein to produce the sintered ore, and sieving the sintered ore into grains and powders. A suitable screen is selected for sieving so as to avoid the introduction of fine particles into the blast furnace. The grains left on the sieve are charged into the blast furnace with the addition of coke in a proportion of 8 to 9% relative to the grains. The powders passed through the sieve are returned to the mixing step preceding the sintering for reuse. The siliceous stone and lime stone are added for the purpose of adjusting the composition of the slag, although such addition is unnecessary when the zinc removed tailings contain such components. The lead blast furnace slag is employed as a slag making agent having a general composition range of 0.01–2.0% Pb, 20.0–30.0% Fe, 5.0–16.0% Zn, 15.0–26.0% $SiO_2$ and 10.0–2.0% CaO. Other substitutes may be employed. For example, the slag in a copper blast furnace or the slag in a copper flash smelting furnace may be employed together with siliceous stone and lime stone. The former has a general composition range of 20.0–35.0% Fe, 1.0–5.0% Zn, 30.0–40.0% $SiO_2$, 5.0–15.0% CaO and 0.10–1.0% Cu and on the other hand the latter has a general composition range of 35.0–45.0% Fe, 0.2–2.0% Zn, 25.0–40.0% $SiO_2$, 1.0–5.0% CaO and 0.3–0.7% Cu. However, in general, the lead content of lead blast furnace slag is at a relatively high level ranging from 2 to 4.5% and repetitive employment of a portion of the slag produced is effective to minimize the loss of lead entrained into the slag. Even when zinc removed tailings are mixed into the lead concentrate before sintering according to this invention, the operational conditions of the sintering process and the blast furnace process need not be made different from the conventional practice and conditions.

It is possible to appropriately change the typical composition ratio mentioned above to obtain the optimum slag for the operation of a particular lead blast furnace refining practice. The amount of zinc removed tailings to be used is determined by the total iron blance and the quantity of zinc present in the slag. If it is desired to obtain a slag containing 25 to 27% of iron, 24 to 25% of silica and 10% of zinc, it is preferable that the amount of zinc removed tailings should not exceed 20% of the amount of the lead concentrate. The use of more than 20% of zinc removed tailings can possibly produce iron in the furnace.

In the case where pyrite cinder is used as iron source according to the conventional practice, there is so much magnetite produced in the lead blast furnace slag that repeated use of such slag may render the furnace operating conditions unstable. In contrast, when zinc removed tailings are employed, only a small amount of magnetite is produced in the slag so as to permit repetitive use of the slag.

What is important in the operation of a lead blast furnace is that the desulfurization be sufficiently effected during the sintering process. The use of zinc removed tailings provides superior effects in this respect as well. In the case of the conventional formula using pyrite cinder, there was an average 1.90% of residual sulfur in the sintered material and at over 40% of the occurrences there was more than 2.0% of residual sulfur content. In contrast, when zinc removed tailings was used, there was an average 1.69% of residual sulfur content and it never occurred that the sulfur content exceeded 2.0%. This is due to the shape and physical characteristics of the zinc removed tailings serving to provide satisfactory draft or ventilation during the sintering process.

The zinc removed tailings also produce salient effects in reaction in a blast furnace. Since they are present in grain form and the interior of grain is not subjected to oxidation, the iron and silicon in the zinc removed tailings are mostly present in the metallic form. Accordingly, a charge of the zinc removed tailings into the blast furnace does not provide a large amount of iron oxides to be reduced in the furnace so that the reducing agents may not be so excessively consumed for the reduction of the iron oxide as to be in short supply.

The iron and silicon in their metallic forms also function as reducing agents and desulfurizing agents to aid in stabilization of the operating conditions and efficiency of the operation of the furnace. As a consequence, the amount of lead lost into the slag is decreased and no accretion is produced in the blast furnace, resulting in an extension of the continuous running time of the furnace (reduction of the shut down time).

In addition, the present invention provides for effectively recovering values such as gold and silver contained in zinc removed tailings. Since the lead blast furnace does not have so strong a reducing atmosphere as the copper blast furnace, a considerable amount of the iron in the zinc removed tailings falls into the slag so that the existence of the iron sets no limit to the capacity of treatment. The gold, silver and copper present in the zinc removed tailings are concentrated in the lead bullion and dross. The dross may be treated in a known manner as by an electric furnace to recover the gold, silver and copper. According to the treatment by an electric furnace, about 90% of the copper and about 96% of the gold and silver, respectively in the zinc removed tailings may be recovered.

It is to be appreciated from the foregoing that the present invention provides an improved efficiency in a lead blast furnace as well as enabling the recovery of valuable metals in zinc removed tailings by utilizing the zinc removed tailings for the lead blast furnace refinery in an expedient manner and that it thus greatly lends itself to the smelting of zinc and lead.

The present invention will now be described with reference to a working example.

EXAMPLE

Lead concentrate, magnetically separated tailings, siliceous stone, lime stone, lead blast furnace slag and powders returned from the sintering process were mixed together at a rate of 128 T/day, 20.2 T/day, 5.1 T/day, 16.0 T/day, 46.2 T/day and 320 T/day, respectively and pelletized in a pelletizer. The thus pelletized mixture was desulfurized and sintered by heating it up to 900° C in a sintering machine. The sintered ore was sieved through a 30 mm mesh screen. The ore passed through the screen was returned to the mixing step preceding the sintering process for reuse while the ore left on the screen was charged into a lead blast furnace together with cokes introduced at a rate of 17 T/day. The operation of the furnace under the normal operating conditions produced lead bullion, dross and slag at a rate of 78.2 T/day, 12.4 T/day and 106.9 T/day, respectively. 46.2 T/day out of the slag was repeatedly used as a silica source in the sintering process.

The operation was very favourably and smoothly run under the foregoing operating conditions for two months. The residual sulfur content in the sintered ore was 1.69% on the average. The lead content in the lead blast furnace slag was 1.66%, exhibiting a marked decrease as compared to the average 3.46% in the case of the conventional process using pyrite cinder. Furthermore, due to the accretion on the furnace it has heretofore been inevitably required to shut down the furnace after the operation for one and a half months. According to the process of this invention, no accretion was observed even after the two months operation and the furnace did not need be shut down. 96.4% of the gold, 96.6% of the silver and 90% of the copper in the zinc removed tailings were recovered according to this invention.

What is claimed is:

1. In a pyrometallurgical lead refining process comprising the steps of sintering raw materials including lead concentrate to produce lead oxide and reducing said lead oxide to metallic lead, the improvement comprising mixing zinc removed tailings obtained in a zinc refining process with said raw materials and said lead concentrate before said sintering step.

2. A process according to claim 1 wherein said zinc removed tailings comprise less than about 5.0 percent by weight zinc, about 1 to about 10 percent by weight copper, about 1 to about 10 g/ton gold, about 500 to about 1,500 g/ton silver, about 2 to about 15 percent by weight silicon and about 50 to about 65 percent by weight iron.

3. A process according to claim 1 wherein said lead concentrate comprises about 45 to about 70 percent by weight lead, about 1 to about 10 percent by weight iron, about 4 to about 15 percent by weight zinc, about 0.1 to about 3.0 percent by weight $SiO_2$, about 0.01 to about 2.0 percent by weight CaO, about 0.1 to about 4 percent by weight copper, about 2 to about 10 g/ton gold, about 500 to about 2,000 g/ton silver and about 10 to about 25 percent by weight sulfur.

4. A process according to claim 1 further comprising roasting said raw materials including said lead concentrate and said zinc removed tailings prior to said sintering step.

5. A process according to claim 4 wherein said roasting and sintering are continuously carried out in a sintering machine and said zinc removed tailings are mixed with the raw materials and lead concentrate before the sintering step.

6. A process according to claim 1 further comprising roasting said raw materials and said lead concentrate in a fluidized roasting furnace wherein said zinc removed tailings are mixed with said raw materials and said lead concentrate after the roasting step and before the sintering step.

7. A process according to claim 1 further comprising pelletizing the mixture of said raw materials, said lead concentrate and said zinc removed tailings before the sintering step.

8. A process according to claim 1 further comprising sieving the sintered mixture before the reducing step.

9. A process according to claim 8 wherein said mixing step comprises mixing with 1 part of lead concentrate about 0.15 to about 0.20 parts of zinc removed tailings, about 0.04 to about 0.05 parts of siliceous stone, about 0.1 to about 0.15 parts of lime stone, about 2.5 parts of sintered mixture powder which passed through a sieve in said sieving step and about 0.3 to about 0.5 parts of slag selected from the group consisting of lead blast furnace slag, copper blast furnace slag and copper flash smelting furnace slag.

* * * * *